US005395013A

United States Patent [19]

Billings

[11] Patent Number: 5,395,013

[45] Date of Patent: Mar. 7, 1995

[54] BEVERAGE DELIVERY APPARATUS PROVIDED WITH A PUMP-CONTAINING ICE CHEST

[76] Inventor: Chris L. Billings, 527 Miller Ave., Salt Lake City, Utah 84108

[21] Appl. No.: 202,162

[22] Filed: Feb. 25, 1994

[51] Int. Cl.[6] ..... B67D 5/60

[52] U.S. Cl. ..... 222/132; 222/144.5; 222/173

[58] Field of Search ..... 222/129.1–129.4, 222/132, 144.5, 146.6, 173; 312/140.2, 236

[56] References Cited

U.S. PATENT DOCUMENTS

| | | | |
|---|---|---|---|
| 2,736,464 | 2/1956 | Walton | 222/129.1 |
| 3,305,136 | 2/1967 | Harris | 222/144.5 X |
| 3,327,902 | 6/1967 | Alterwitz | 222/129.1 X |
| 3,331,536 | 7/1967 | DeLorenzo | 222/129.1 X |
| 3,664,550 | 5/1972 | Carothers et al. | 222/144.5 X |
| 3,940,019 | 2/1976 | Kross et al. | 222/129.4 X |
| 3,949,902 | 4/1976 | Thompson | 222/129.1 |
| 3,983,583 | 10/1976 | Herman et al. | 312/236 X |
| 4,162,028 | 7/1979 | Reichenberger | 222/144.5 X |
| 5,056,686 | 10/1991 | Jarrett | 222/129.2 |
| 5,152,429 | 10/1992 | Billings | 222/129.2 |
| 5,192,003 | 3/1993 | Billings | 222/129.1 |
| 5,263,613 | 11/1993 | Billings | 272/129.1 |

*Primary Examiner*—Gregory L. Huson
*Attorney, Agent, or Firm*—M. Ralph Shaffer

[57] ABSTRACT

Beverage delivery structure including a counter top with support structure and also an ice chest conveniently supplied proximate the counter top; the ice chest is provided with an insert structure containing a beverage delivery pumping unit and, thereabove, a well for receiving a series of beverage bottles; a primary source of a beverage constituent as well as beverage delivery structure are coupled to the intake and output ports of the pumping unit.

6 Claims, 3 Drawing Sheets

BEVERAGE DELIVERY APPARATUS PROVIDED WITH A PUMP-CONTAINING ICE CHEST

FIELD OF INVENTION

The present invention relates to beverage delivery structures and, more particularly, to suitable structure which is provided an ice chest, the ice chest having disposed interiorly thereof an insert structure which contains a pumping unit as well as a beverage bottle well disposed above the pumping unit and separated therefrom by a partition.

BRIEF DESCRIPTION OF PRIOR ART

The present invention is directed to the field of delivering beverages in hotels, restaurants, homes and other establishments. Beverage bar structures and systems are a well-developed art and the inventor owns three related patents applicable thereto and fully incorporated herein by way of reference, as follows: U.S. Pat. Nos. 5,152,429; 5,192,003; and 5,263,613. The various U.S. patent document references cited in each of these three patents illustrates several additional types of delivery systems. Central to the delivery system is a source of beverage ingredient such as a syrup or juice container, and so forth. A conduit couples this source to the input of a fluid pumping unit. These pumping units may take any one of several forms, some of which are shown in the above cited patents. The pumping unit may contain one or more pumps that are electrically driven, fluid (water) driven, $CO_2$ driven, and so forth. The dispensing system connected to the pumping unit may comprise any one of several dispensers that are extant such as, for example, the Wunder-Bar dispenser system manufactured by Automatic Bar Controls, Inc. Such a dispenser unit is useful for mixing liquids, selectively making dispensations, operating the pumps, and so on. All of this is well developed in the prior art.

One type of pump which may be incorporated in the pumping unit is known as a Shur-flow Brix pump. Other types of fluid delivery pumps known in the prior art can serve as well.

The counter or bar areas are generally supplied with an ice chest, containing ice for glasses, and for keeping the beverage bottle cool and so forth. Frequently there will be supplanted a well structure which is fitted into the ice chest and supported by the upper lips thereof. Absent in the prior art is a concept of containing the pumping unit within the ice chest and also of providing a bottle well structure above the pumping unit to provide a bottle storage area accommodating the server. It would be most desirable to have the pumping unit within the ice chest for a variety of reasons: 1) to save space, 2) to have the ice chest self-containing the pumping unit for the delivery system, and 3) to keep the liquids within the pumping unit cool during down times of intermittent operation of the dispenser. Furthermore, where the housing containing the pumping unit is disposed within the ice chest, floor space and counter space are saved and additional support structures for the pumping unit are not required.

BRIEF DESCRIPTION OF THE INVENTION

In the present invention a counter top is provided with its usual support structure. An ice chest is likewise provided, the same including, preferably, a structure for receiving removable beverage storage bottles, this so that the bottles may be kept cool by ice disposed within the chest. Preferably disposed adjacent this primary fluid bottle storage unit is an insert structure comprising a housing provided with a lower cavity, for containing the pumping unit of the system, and an upper cavity or well, suitable for releasably receiving bottles, which is disposed immediately above the storage pump area or cavity but separated therefrom by a partition, floor, or other bottle support. The dispenser unit is coupled to the pumping unit and is constructed for suitably dispensing water or mixed liquids into the glasses or cups of users. The pumping unit is provided with means so the pumps can be driven by compressed carbon dioxide, by an incoming pressured water supply, be electrically driven, and so forth.

OBJECTS

Accordingly, a principal object of the present invention is to provide a new and improved beverage delivery structure.

A further object of the invention is to provide beverage delivery structure wherein the pumping unit of such structure is contained within the ice chest customarily supplying counters, wet bars, and the like.

A further object of the invention is to provide a pumping unit contained within an ice chest wherein the pumping unit is provided with a housing that also presents a well for the reception of beverage bottles which are placed to be placed above the pumping unit.

A further object of the invention is to provide improved structure for supporting a housing within an ice chest, this wherein the housing is designed to contain not only a pumping unit but also a structure directly thereabove for receiving beverage bottles.

IN THE DRAWINGS

The features of the present invention, together with further objects and advantages thereof, may best be understood by reference to the following detailed description taken in conjunction with the following drawings in which.

DETAILED DESCRIPTION OF PREFERRED EMBODIMENTS

Figure 1:
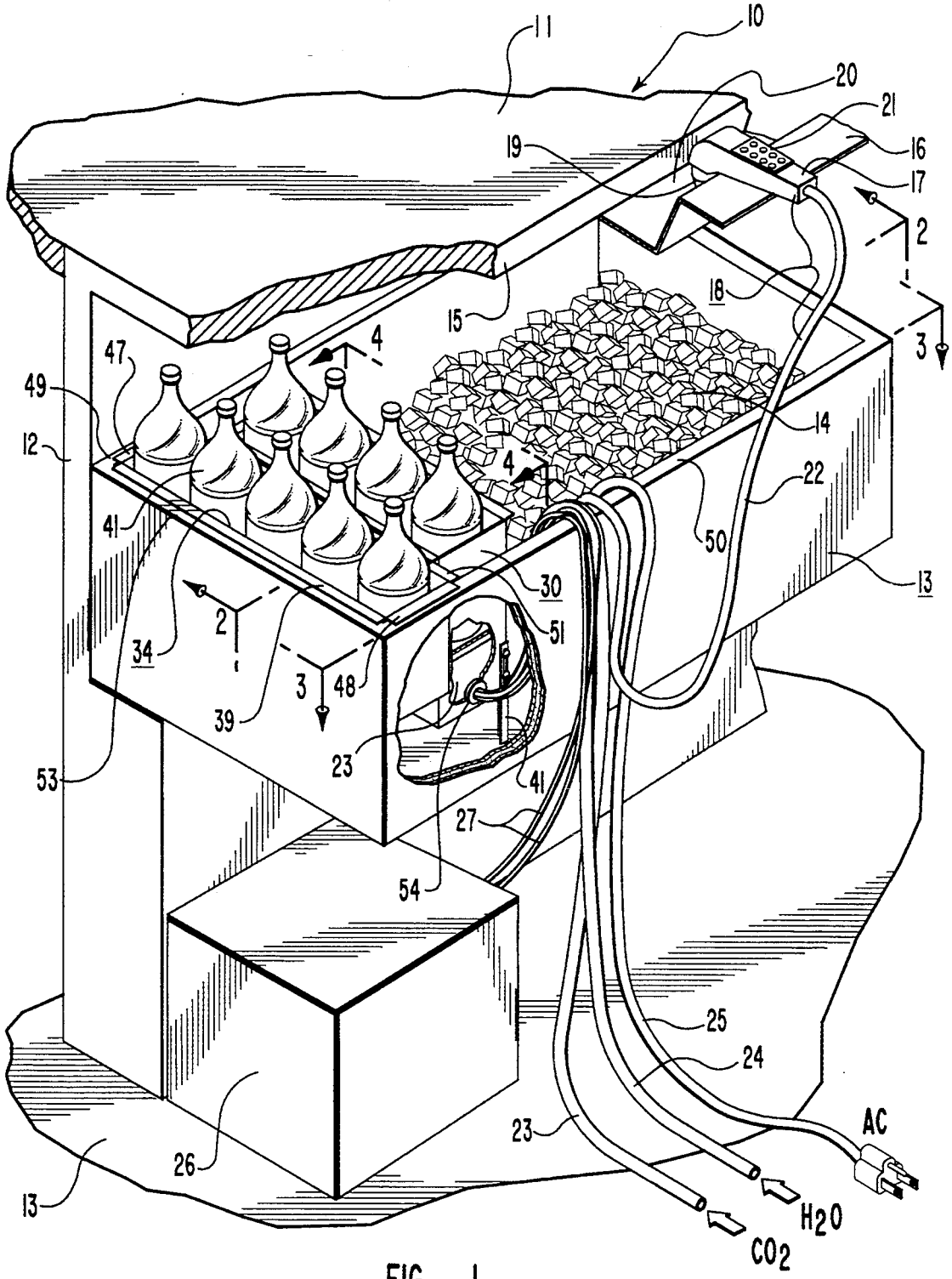
FIG. 1 is a perspective view, partially cut away, of one embodiment of the invention showing a beverage bar structure equipped with an ice chest having, self-contained, a fluid delivery pumping unit.

In FIG. 1 the beverage delivery structure 10 is shown to include a horizontal counter top or table top 11 which is supported by support structure 12 attached thereto and resting upon floor 13. Secured by bolts or any other means desirable to the support structure 12 is an ice chest 13 containing ice 14. The rear lip 15 of counter top 11 is provided a trough 16 provided with a drain line, not shown, this for supporting and receiving hand-held dispenser 17 of dispenser unit 18. The dispenser 17 includes a spout outlet 19 that can be conveniently fitted into a receptacle, not shown, attached to the trough 20. The dispenser may form part of an overall dispenser unit 18, as aforesaid, which may comprise a unit known in the industry as a "Wunder-bar" dispenser, or other type of dispenser common in the art. A dispenser at 17 of such Wunder-bar unit include a series of control buttons 21, as is common in the art for regulating flow, providing on/off actuation of the dispenser, and mixing liquids with water, $CO_2$, and so forth. Beverage conduit 22 will comprise a series of lines for the various beverage ingredients, as is standard in the art, and which will proceed to pumping unit 23. Pumping unit 23 will comprise one or more positive flow fluid Brix pumps or any other type of pump or series of pumps useful for pumping liquids to the dispenser unit. Representative pumping units are shown, by way of example, in the inventor's own U.S. Pat. Nos. 5,263,613, 5,152,429, and 5,192,003 the disclosures of which are fully incorporated herein by way of reference. The pumps of the pumping unit to be driven by compressed carbon dioxide, by pressured water, or by an electrical source, this being indicated by the lines 23, 24, and 25, and one or more of which will be connected to the pumping unit. Likewise coupled to the pumping unit will be a beverage ingredient source 26 having one or more lines 27 likewise coupled to the pumping unit.

Figure 4:
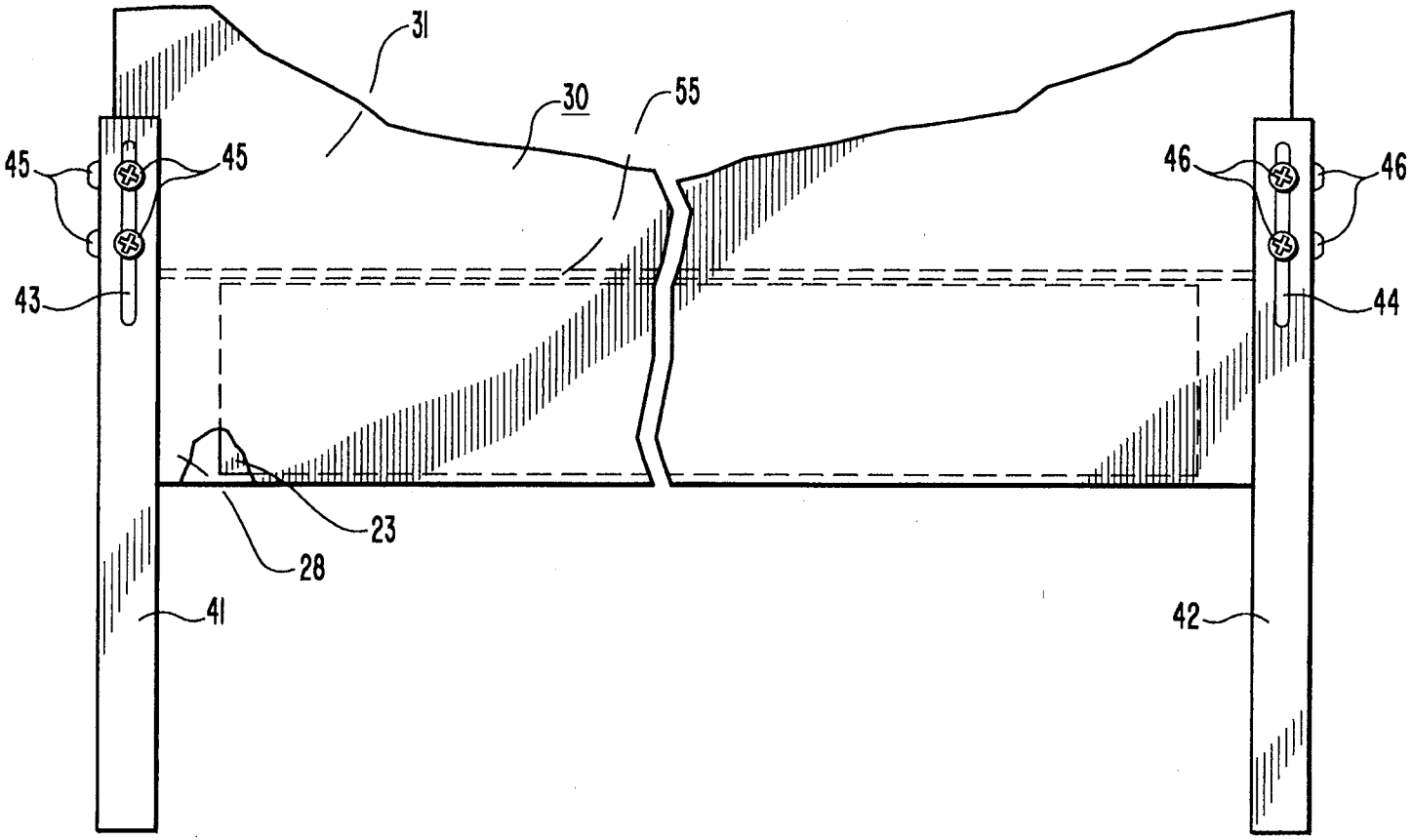
FIG. 4 is an enlarged view, taken along the line 4—4 in FIG. 1 and illustrating that vertically adjustable legs can be supplied the insert housing of the structure.

At this juncture it is important to note the pumping unit 23 is contained within a cavity 28, see FIG. 4, of the housing 29 of insert structure 30. In addition to cavity 28, the insert structure 30 is provided with a bottle-receiving well or cavity 31, separated from cavity 28 by bottle-supporting partition 55, and accordingly receiving a series a series of bottles 32, for the convenience of the user or waiter. Housing 29 includes opposite sides provided with oppositely extending flanges 33 and 52. The purpose for the location of the pumping unit within the lower cavity 28 of insert structure 30 is quite important. This purpose is for the ice chest to self-contain the pumping unit, rather than taking up floor, shelf, or counter space for such unit. Additionally, fluids contained by the pumping unit during and between operations as effected by the dispenser 17 can be kept cool.

Figure 2:
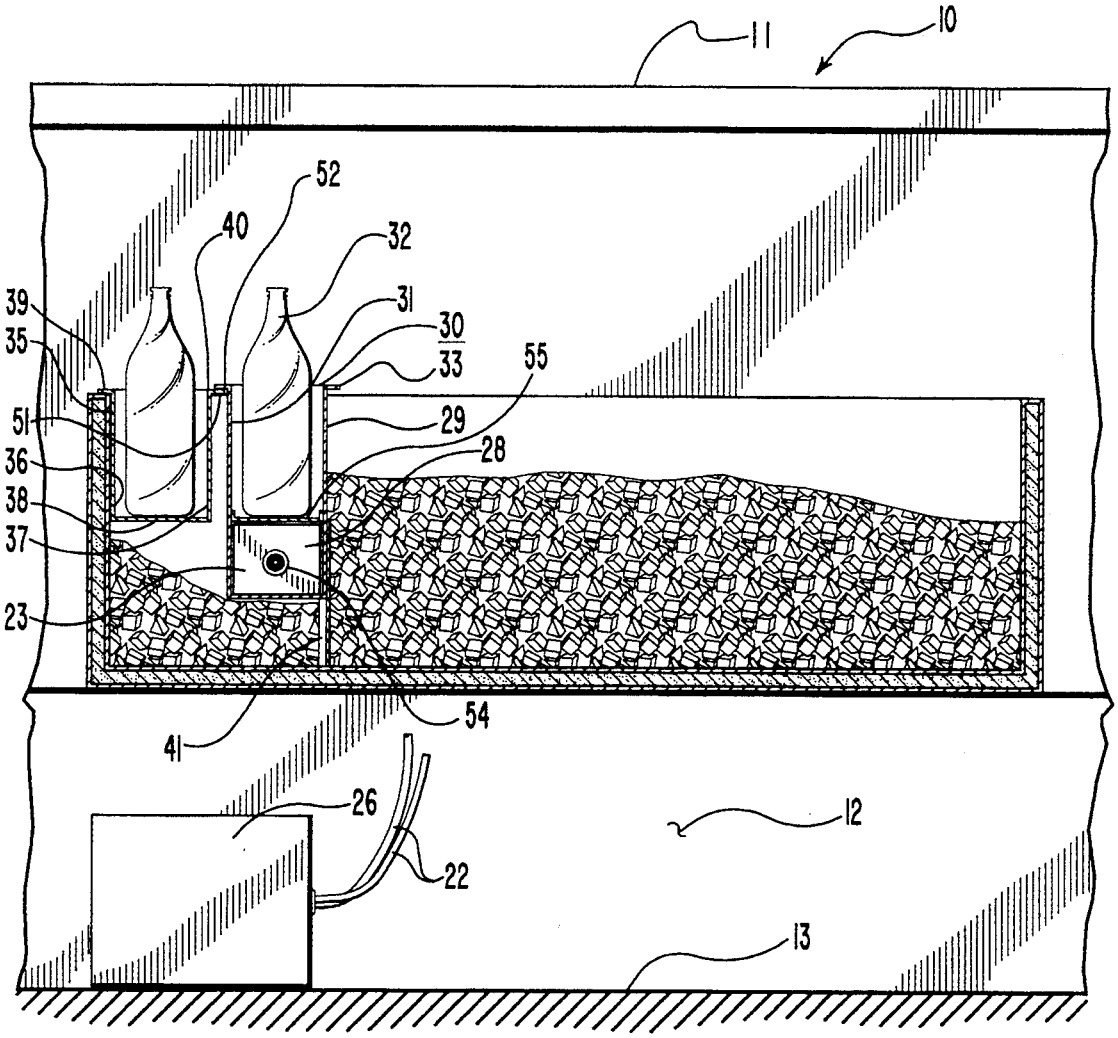
FIG. 2 is a longitudinal vertical cross-section taken along the line 2—2 in FIG. 1.

Likewise disposed in the ice chest is a bottle receptacle unit 34, see FIGS. 1 and 2, having housing 35 provided opposite walls 36 and 37, a bottom 38, and the various flanges 39, 51, 47 and 48. This bottle receptacle unit 34 includes a series of bottles 41 as indicated. It is important to note that the adjacent flanges of the bottle receptacle unit 34 and also the insert structure 30 can overlap, the left-directed flange 52 of insert structure 30 being disposed on top, whereby that margin or flange of the insert structure 30 is supported by flange 40 of bottle receptacle unit 34. Additional support can be provided by flange 33 resting upon other structure or, in the embodiment shown, vertically adjustable legs 41 and 42, see also FIG. 4, may be provide the insert structure 30. This can be accomplished by these adjustment legs 41 and 42 of perhaps angular transverse cross-section, being provided with slots 43 and 44 at their adjacent flanges that receive adjustment screws 45 and 46 which are threaded into the housing of the insert unit 30.

Figure 3:
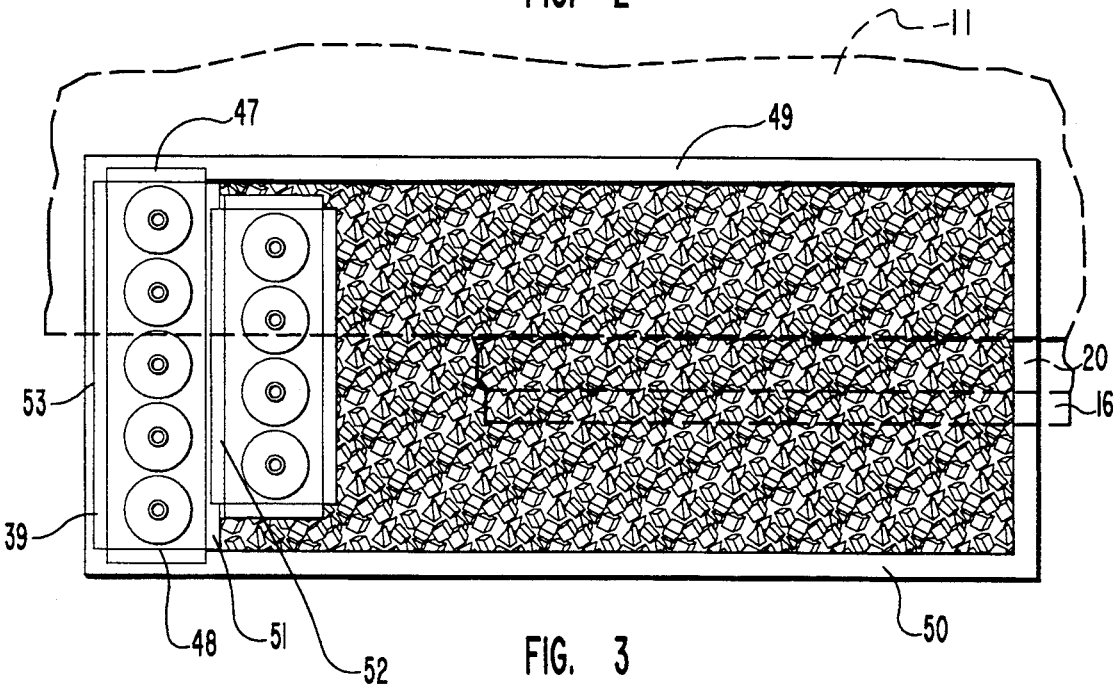
FIG. 3 is a plan view taken along the line 3—3 in FIG. 1.

As seen in FIG. 3, the bottle receptacle structure 34 has a series of flanges 39, 51, 47, and 48 which overlap the upper edges 49, 50, and 53 of ice chest 13. The flange on the left at 52, see FIG. 2, is seen to overlap the flange 51 in FIG. 3. Accordingly, the bottle receptacle unit 34 seen to be useful not only for containing several bottles occurring therein but also for supporting the leftward lip or flange 52 of the insert structure. It is important to note that the housing of the insert structure supplies a cavity for receiving bottles so that optimal space usage is provided.

As to assembly and installation, the ice chest will be installed and secured by bolts or other means to the support structure 12 in FIG. 1 as indicated. Subsequently, the bottle receptacle unit 34 is dropped into the ice chest such that three of its outwardly extending flanges rest upon the upper lips of such chest. After this operation the ice chest insert structure 30 is dropped in place such that its left flange 52 proceeds over and rests upon the right flange 51 of the bottle receptacle unit 34. Housing 29 will be provided with gussets or suitable interconnection fittings, not shown, which receive at 54 the various hoses, conduit, connectors and so forth, and also for providing admittance for beverage conduits 22 which will be connected to the pump inlet 54 of the pumps. One or more of the lines at 23, 24, and 25 will be provided whereby the dispenser at 17 can be operated by the user simply pressing one or more of the conventional push button controls 21 supplied the dispenser, so that the mixed beverage liquid proceeds out of spout 19.

Accordingly, it is seen that a pumping unit is self-contained within the ice chest; because of this, floor space. shelf space, and counter top space are not required for the pumping unit to be installed. Additionally, the pumping unit, stored in the lower portion of a housing suitably supplied, has an upper housing structure providing a well or cavity for receiving an additional set of bottles.

What is provided therefore is improved beverage delivery structure wherein the driving unit or pumping unit needed is self-contained within an ice chest so as to optimize convenience and minimize the requirements of additional space to support or otherwise accommodate the pumping unit.

While particular embodiments have been shown and described, it will be obvious to those skilled in the art that various changes and modifications may be made without departing from the essential aspects of the invention and, therefore, the aim the inventor claims is to cover all such changes and modifications as fall within the true spirit and scope of the invention.

What I claim is:

1. Beverage delivery structure including, in combination: a counter top; support structure secured to and depending from said counter top to floor level; an ice chest having upper lips and secured above floor level to said support structure spacedly beneath said counter top; an insert structure disposed within said ice chest and containing a beverage delivery pumping unit provided a beverage ingredient intake; a dispenser unit coupled to said pumping unit and releasably secured proximate said counter top; a beverage ingredient source disposed beneath said ice chest; conduit intercoupling said beverage ingredient source to said pumping unit; means for driving said pumping unit coupled thereto, said insert structure including a housing containing said pumping unit and defining a bottle receiving and storing cavity positioning above said pumping unit.

2. The beverage delivery structure of claim 1 wherein said housing of said insert structure is provided with: a lower cavity receiving said pumping unit, upstanding, mutually horizontally spaced walls defining said bottle receiving and storing cavity, and side-opposite, outwardly extending support flanges for supporting said housing within said ice chest.

3. The beverage delivery structure of claim 2 wherein said ice chest has a bottom, said housing including at least one vertically-adjustable leg for engaging and at least in part supporting said housing above said bottom of said ice chest.

4. The beverage delivery structure of claim 2 wherein said ice chest is adapted to receive a separate bottle receptacle having outwardly projecting upper support flanges for engaging said lips of said ice chest, one of said support flanges of said insert structure engaging one of said upper support flanges of said separate bottle receptacle.

5. Beverage delivery structure including, in combination: first means including a pumping unit and a dispenser for dispensing beverages; a counter top; second means coupled to said counter top for supporting the same, and an ice chest disposed beneath said counter top and provided with a housing insert containing said pumping unit, said housing insert also having structure defining a bottle receiving cavity disposed above said pumping unit.

6. Insert structure for an ice chest supplied in an external wet bar, including, in combination; a housing defining a lower cavity for receiving a beverage pumping unit and an upper cavity disposed directly above said lower cavity for receiving a series of beverage bottles, said housing also including a partition disposed between said upper and lower cavities and having at least one upper, outwardly extending support flange for engaging said ice chest.

* * * * *